US005575097A

United States Patent [19]

Chou et al.

[11] Patent Number: 5,575,097

[45] Date of Patent: Nov. 19, 1996

[54] PAGE TURNING DEVICE

[75] Inventors: Jeffrey P. Chou, 735 Menlo Ave. #4, Menlo Park, Calif. 94025; Ronald Ih, San Francisco, Calif.

[73] Assignees: Jeffrey P. Chou; Ronald H. Ih, both of Menlo Park, Calif.

[21] Appl. No.: 405,533

[22] Filed: Mar. 16, 1995

[51] Int. Cl.[6] ..... B42D 9/04

[52] U.S. Cl. ..... 40/531; 84/521; 84/487

[58] Field of Search ..... 40/530, 531, 532, 40/470, 475, 463, 473; 84/521, 486, 487, 489, 502

[56] References Cited

U.S. PATENT DOCUMENTS

| | | | |
|---|---|---|---|
| 1,134,024 | 3/1915 | Spitler | 84/521 |
| 1,320,506 | 11/1919 | Spliter | 84/487 |
| 3,371,571 | 3/1957 | Barbera | 40/531 X |
| 3,570,154 | 3/1971 | Cosenza | 84/487 X |
| 4,031,644 | 6/1977 | Rogers | 40/104 A |
| 4,040,195 | 8/1977 | Claypool et al. | 40/341 |
| 4,072,080 | 2/1978 | Conlin | 84/486 |
| 4,102,071 | 7/1978 | D'Arcy | 40/531 |
| 4,121,361 | 10/1978 | D'Arcy | 40/470 |
| 4,346,641 | 8/1982 | Kobayashi | 84/487 |
| 4,432,154 | 2/1984 | D'Arcy | 40/531 |
| 4,545,141 | 10/1985 | Ito et al. | 40/531 |
| 4,553,467 | 11/1985 | Goldner | 84/487 |
| 4,632,007 | 12/1986 | Turcsány et al. | 84/487 |
| 4,685,374 | 8/1987 | Goldner | 84/487 |
| 4,719,712 | 1/1988 | Moreau et al. | 40/475 |
| 4,773,297 | 9/1988 | Anderson | 84/521 |
| 4,870,258 | 9/1989 | Mochizuki et al. | 235/379 |
| 4,936,034 | 6/1990 | Chen et al. | 40/531 |
| 5,052,266 | 10/1991 | Burster | 84/493 |
| 5,067,682 | 11/1991 | Figaro | 248/453 |
| 5,090,683 | 2/1992 | Kamath et al. | 271/227 |
| 5,203,248 | 4/1993 | Carr et al. | 84/487 |
| 5,233,900 | 8/1993 | Fitzgerald | 84/497 |
| 5,247,755 | 9/1993 | Sato et al. | 40/476 |

FOREIGN PATENT DOCUMENTS

| | | | |
|---|---|---|---|
| 63708 | 8/1892 | Germany | 84/521 |
| 628714 | 9/1949 | United Kingdom | 84/487 |

*Primary Examiner*—Kenneth J. Dorner
*Assistant Examiner*—Cassandra Davis

[57] ABSTRACT

A page turning device for use with any bound pages such as books, music scores, or binders, which have small ferrous elements (14) attached to the edge of each page. The device uses a motorized arm (16) with a magnetic tab (17) mounted on the end to engage individual pages and turn them in either the forward or reverse direction. The magnetic tab (17) is raised during a page turn, but rests in a downward position between page turns so as to not interfere with manual manipulation of the pages. The device further incorporates foot actuated user switches (12,13) which control the mode of operation and cause the device to turn a page in the appropriate direction.

20 Claims, 7 Drawing Sheets

PAGE TURNING DEVICE

Background—Field of Invention

This invention relates to devices that automate the turning of pages of a book or binder.

Background—Description of Prior Art

Musicians, those with impaired arm use, and others otherwise unable to conveniently turn pages will benefit from the present invention which provides the mean:; for automatically turning pages in either direction.

Many page turning devices have been suggested. One such device as specified in U.S. Pat. No. 4,773,297 issued to Anderson on Sep. 27, 1988 uses a magnetic method for turning pages. However, due to the eccentric mounting of the arm with respect to the shelf and book, this device does not have the capability to turn pages in the reverse direction. Furthermore, the device described in U.S. Pat. No. 4,773,297 is considerably more limited in the size of printed material that it can handle due to the method of magnetic disengagement. The page turning method used by the device described in U.S. Pat. No. 4,773,297 also requires that the arm be of a fairly long length adding to size and bulk of the device.

Another page turning device as specified in U.S. Pat. No. 4,936,034 issued to Chen, et al on Jun. 26, 1990 uses a dual arm system with a suction cup to execute page turning. The device described in U.S. Pat. No. 4,936,034 does not permit the turning of pages in the reverse direction and the suction cup method of adhering to pages is unreliable. Improving the suction though use of a vacuum pump as described in one of the embodiments of U.S. Pat. No. 4,936,034 increases the complexity of the described device and decreases portability.

A third device described in U.S. Pat. No. 5,203,248 issued to Carr, et al on Apr. 20, 1993 utilizes special tubular tabs mounted to the top of each page and an endless cable system to provide page turning action. The system described above cannot be used with bound books and is quite limited in the number of pages it can handle due to the use of the "torpedo tabs." The device described above also requires excessive setup time to place and remove pages since each page must be individually attached and detached each time the user wants to change the material on the stand. Other devices suggested are either not mechanically feasible or extremely limited in their capabilities.

OBJECTS AND ADVANTAGES

The advantages of our page turning device include the following: Our page turning device (1) is capable of turning pages in either the forward or reverse directions, (2) can handle a wide range of page sizes, (3) utilizes a short, non-obtrusive arm, (4) can turn an unlimited number of pages in either direction, (5) requires minimal setup for operation, (6) allows for ease of placement and removal of printed material, (7) allows for manual page turning if desired, and (8) is portable.

Thus the present invention described herein provides the user with a reliable means of turning any number of pages of printed material in either direction. The device can handle a wide range of page sizes and is not much larger than a standard music or reading stand. Our page turning device is quiet and efficient in its use of electricity so that battery power is quite practical. The device is designed so that it will allow placement and removal of printed material with minimal effort and does not obstruct the user from performing manual page turning if so desired.

SUMMARY OF THE INVENTION

The present page turning device enables the user to turn pages of a book or binder by a foot switch so that the user's hands are free to perform other duties. The device operates with books by attaching small ferrous clip-on tabs to the bottom of each page or with plastic sheet holders with integral ferrous tabs for use with loose pages.

Briefly, the present invention is a device for turning of pages comprising:

- a first assembly having a first electro-motive device and means for conveying rotational energy from said electro-motive device to a final drive shaft, said assembly being mounted on a frame;
- an arm member mounted on one end to said final drive shaft, said arm member being rotationally moveable in a horizontal plane;
- a magnetic tab mounted pivotally on said arm member, distal to said shaft, said tab being rotationally moveable from a down position to an upright position in a vertical plane parallel to that of a page positioned behind and adjacent to said device, thereby allowing said magnetic tab to engage a ferrous element on said page when said magnetic tab is in the upright position and allowing said magnetic tab to disengage from said ferrous element on said page when said magnetic tab is rotated to the down position;
- a second assembly having a second electro-motive device and means of converting rotational energy to linear energy from said second electro-motive device to said magnetic tab causing said magnetic tab to pivot;
- an electronic circuit that controls the operation of said electro-motive devices; and
- an electro-mechanical transducer connected to said electronic circuit which communicates user inputs to said electronic circuit.

List of Reference Numerals

Figure 1:
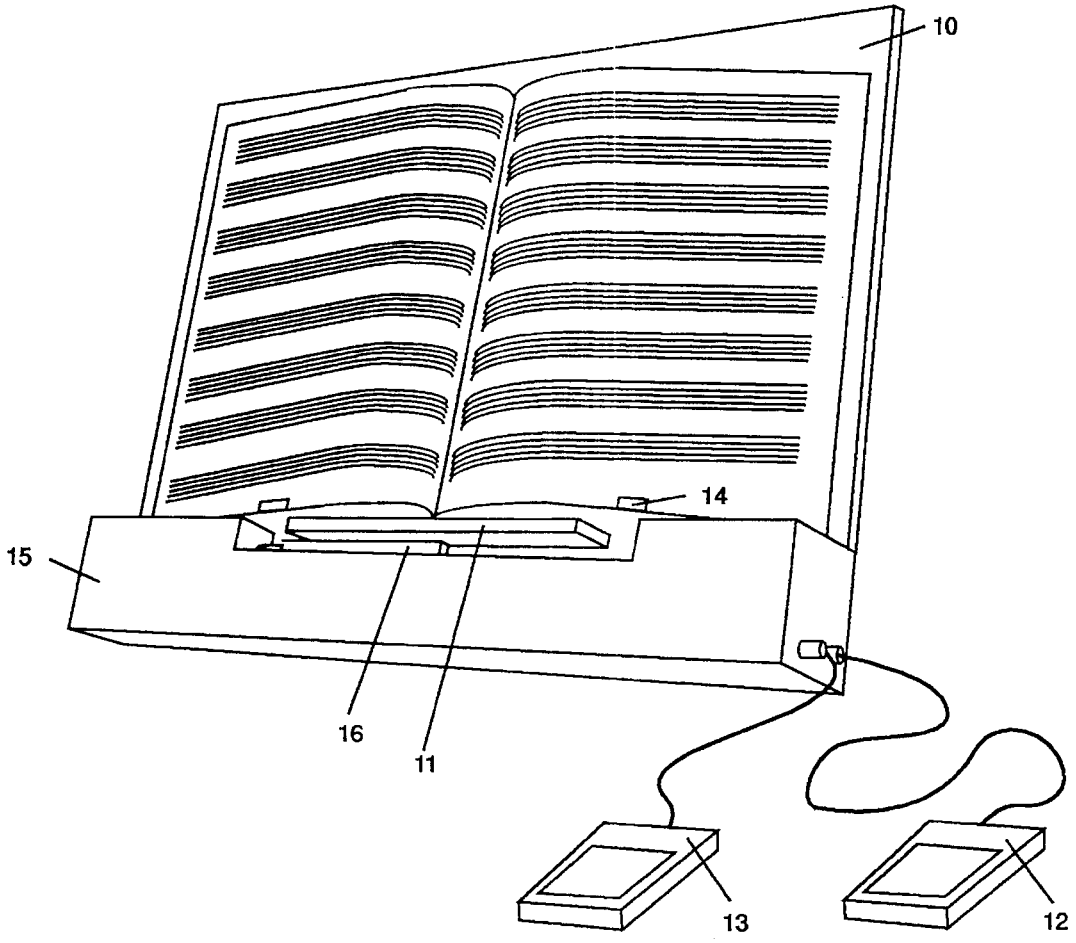
FIG. 1 is a perspective view of a preferred embodiment of our page turning device.
Figure 2:
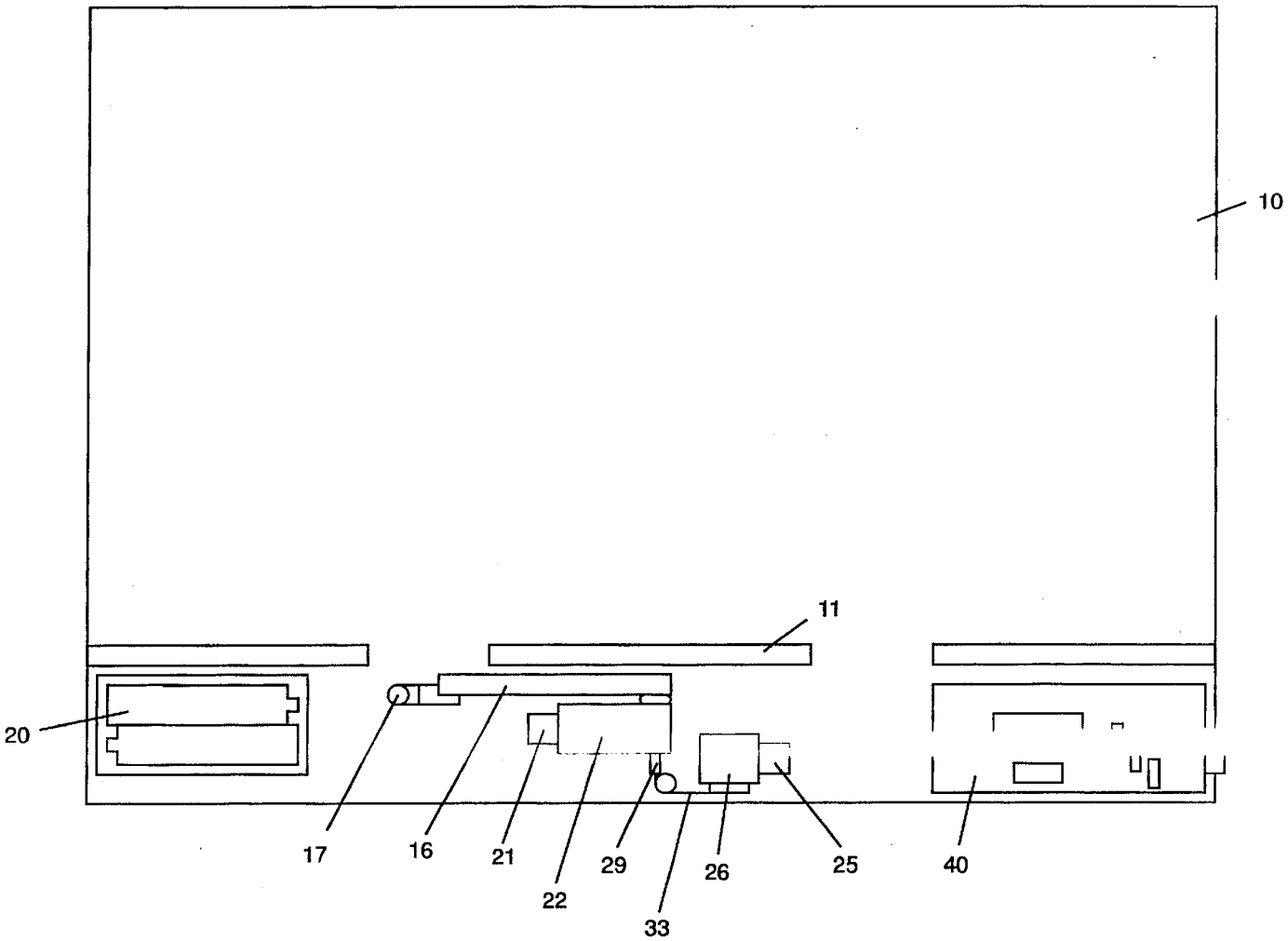
FIG. 2 is an exposed frontal view showing the arrangement of sub-assemblies.
Figure 3:
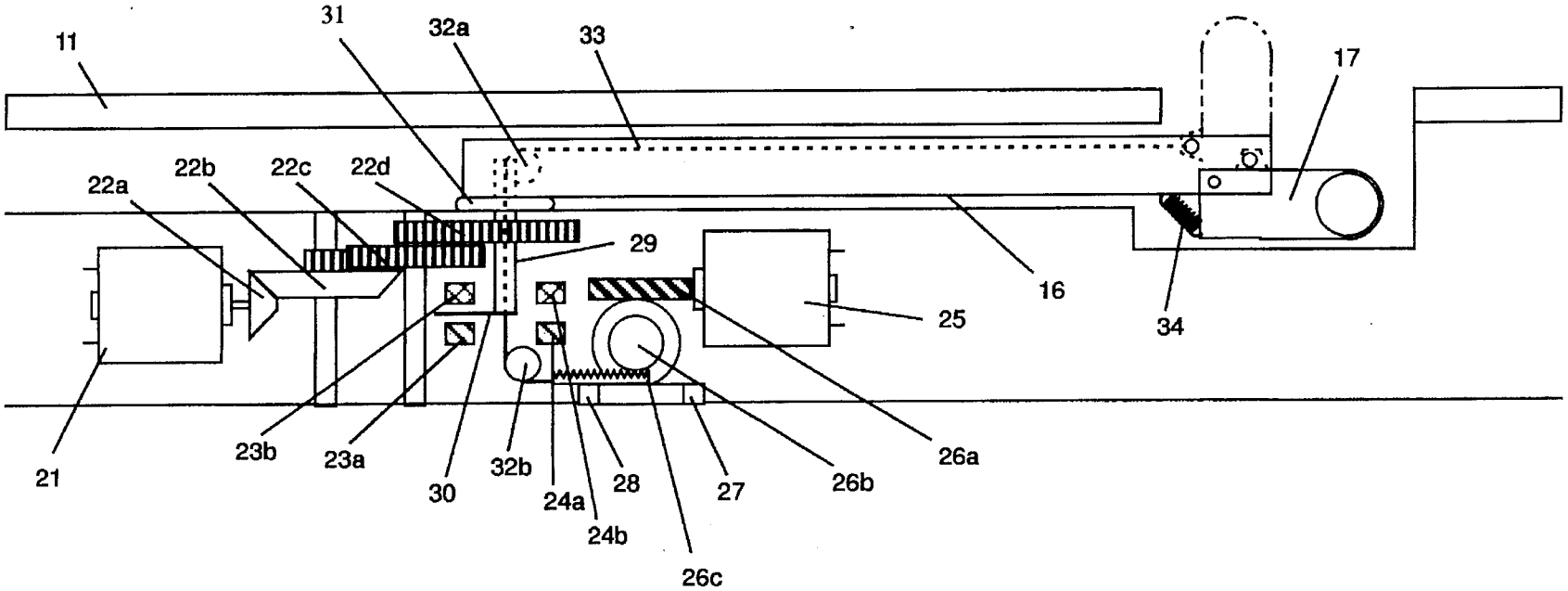
FIG. 3 is a more detailed view of the mechanical arm and motor-gear box assembly.
Figure 4:
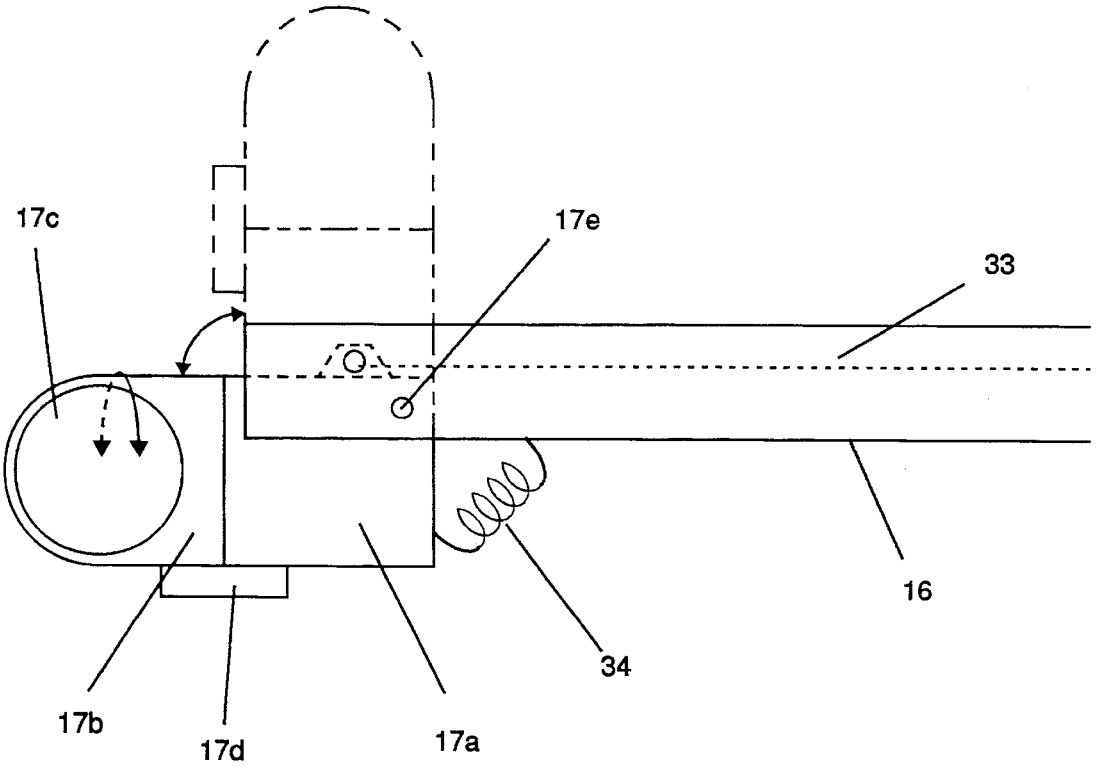
FIG. 4 is an enlarged view of the magnetic tab sub-assembly.
Figure 5:
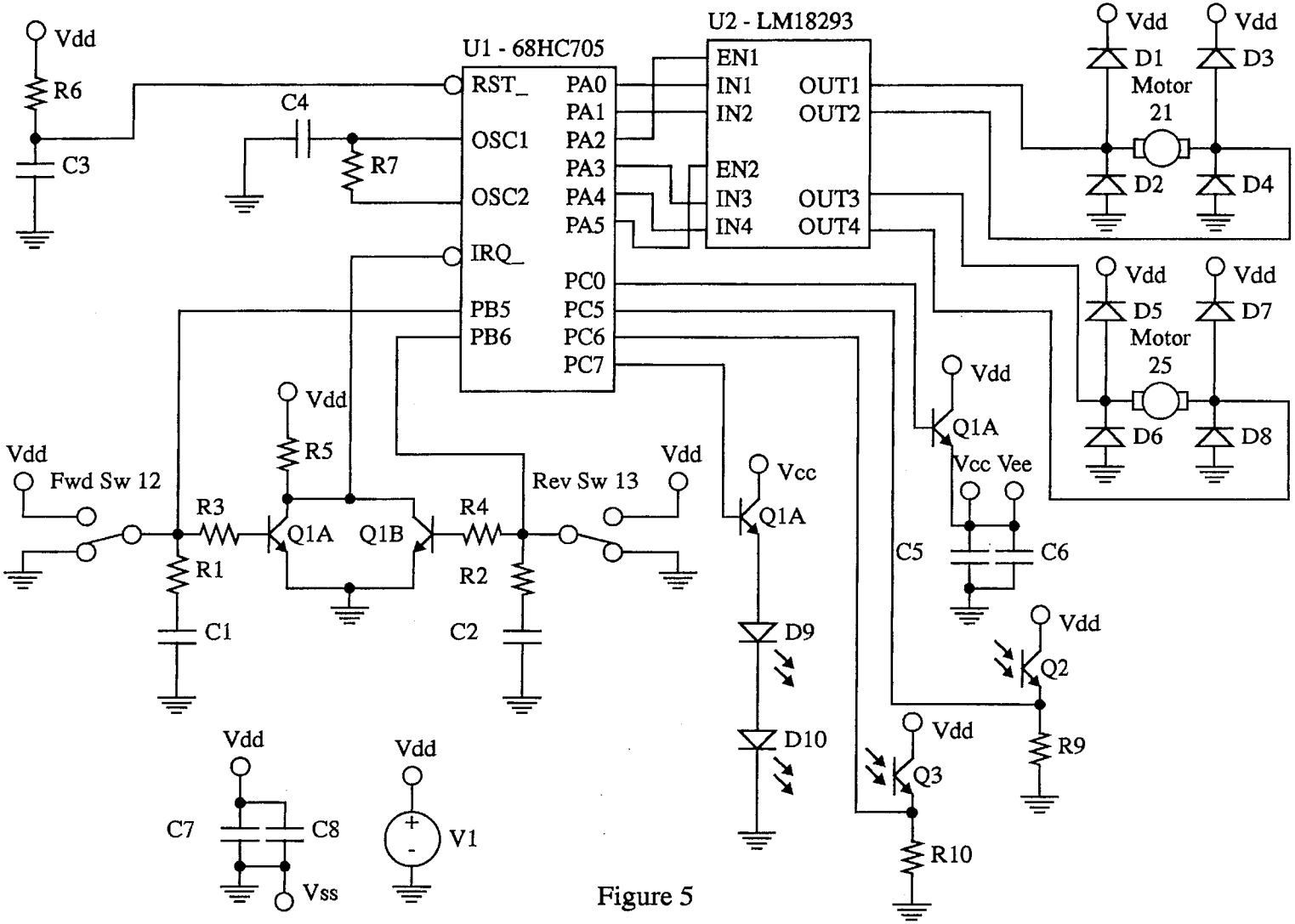
FIG. 5 is the electrical schematic.
Figure 6:
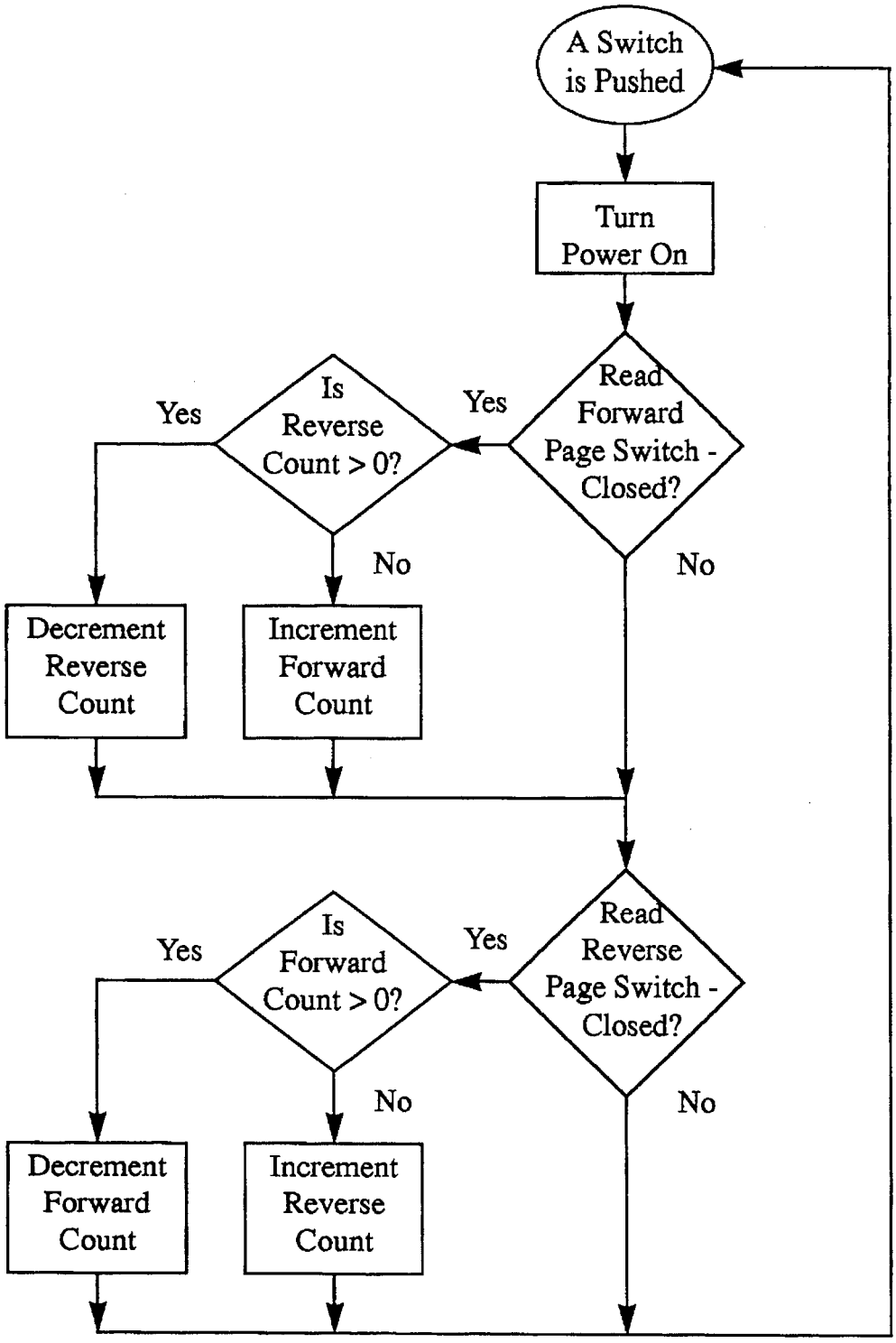
FIG. 6 is the interrupt handier flowchart.

FIG. 1—Perspective View
10—backboard
11—center shelf
12—forward switch and cable
13—reverse switch and cable
14—ferrous tab on page
15—enclosure
16—mechanical arm FIG. 2—Exposed Frontal View
17—hinged magnetic tab assembly
20—battery holder
21—arm motor
22—arm gear assembly
25—tab motor
26—tab gear assembly
29—hollow arm shaft
33—tab cable
40—electronic controller board
FIG. 3—Mechanical Arm and Gear Box Assembly
22*a, b,c,d*—arm motor reduction gears
23*a*—arm right LED
23*b*—arm right detector
24*a*—arm left LED
24*b*—arm left detector
26*a,b,c*—tab motor reduction gears
27—tab up micros witch
28—tab down microswitch
30—arm position indicator
32*a,b*—tab cable pulleys
34—tab return spring
FIG. 4—Magnetic Tab Assembly
17*a*—lower tab
17*b*—upper tab
17*c*—magnet
17*d*—upper tab hinge
17*e*—main hinge
FIG. 5—Electrical Schematic
U1—microprocessor—Motorola MC68HC05 Family
U2—motor Driver—National Semiconductor LM18293
Q1A—D–quad BJTs
12—forward Switch
13—reverse Switch
21—arm motor
25—tab motor
D1–8—diodes
D9—Arm Right Position LED
D10—Arm Left Position LED
Q2—Arm Right Position Detector
Q3—Arm Left Position Detector
R1–10—Resistors
C1–8—Capacitors
V1—Direct current voltage source

DESCRIPTION OF PREFERRED EMBODIMENT

In one embodiment, the present page turning device comprises the following:

a frame;

a first electric motor mounted to said frame and operably engaged to a rotatable shaft;

an arm mounted on said shaft at a proximal end for rotation through an arc by said shaft;

a member pivotally mounted at a distal end of said arm and biased to a first position generally parallel to said arm;

a magnetic tab on said member;

a second electric motor mounted to said frame;

means to convert rotary motion to linear motion operably associated with said second motor;

a cable linking said member to said means to convert rotary power in order to rotate said member to a second position, which is not parallel to said arm when said second motor is actuated;

a controller for operating said motors;

a forward switch operably connected to said controller for sequentially, (1) actuating said second motor to move and said member to said second position, (2) actuating said first motor to move said arm through said arc, (3) deactuating said second motor to allow said tab to return to said first position, and (4) actuating said first motor to return said arm through said arc;

a reverse switch operably connected to said controller for sequentially, (t) actuating said second motor to move and said member to said second position, (2) actuating said first motor to move said arm through said arc, (3) deactuating said second motor to allow said tab to return to said first position, and (4) actuating said first motor to return said arm through said arc; and a power source for said electronics.

As illustrated in FIG. 1, one embodiment of our page turning device consists of a backboard 10 with a center shelf 11 which supports the printed material. A ferrous tab 14 is attached to the bottom of each page. An enclosure 15 houses all electrical and mechanical assemblies and components. A forward switch and cable 12 and a reverse switch and cable 13 attaches to the device. A mechanical arm 16 resides between center shelf 11 and enclosure 15. FIG. 2 illustrates an exposed frontal view of all major subassemblies. A battery holder 20 connects to an electronic controller board 40. Magnetic tab 17 is hinged mounted to mechanical arm 16. Mechanical arm 16 is mounted on a hollow shaft 29 which is driven by an arm motor 21 via an arm gear assembly 22. Magnetic tab 17 is actuated by a tab motor 25 via a tab gear assembly 26 and a tab cable 33.

FIG. 3 illustrates the arm and gear box subassemblies. Arm motor 21 drives mechanical arm 16 through a series of arm motor reduction gears 22*a*, 22*b*, 22*c*, and 22*d*. Hinged magnetic tab 17 is pulled into an upright position by tab cable 33 which is routed through mechanical arm 16 and hollow shaft 29 to a tab motor reduction gear 26*c*. Tab cable 33 is guided by tab cable pulleys 32*a* and 32*b*. Hinged magnetic tab 17 is pulled into its resting or downward position by a tab return spring 34. Tab cable 33 is pulled by tab motor 25 which drives tab motor reduction gears 26*a*, 26*b*, and 26*c*. Hinged magnetic tab 17 is detected to be in the upright position when a tab up microswitch 27 is actuated by tab motor reduction gear 26*c*. Similarly, hinged magnetic tab 17 is detected to be in the downward position when a tab down microswitch 28 is actuated by tab motor reduction gear 26*c*. An arm position indicator 30 is affixed to hollow shaft 29. Mechanical arm 16 is detected to be in the right hand position when an arm right detector 23*b* is blocked from an arm right LED 23*a* by arm position indicator 30. Similarly, mechanical arm 16 is detected to be in the left hand position when an arm left detector 24*b* is blocked from an arm left LED 24*a* by arm position indicator 30. A thrust bearing 31 mechanically isolates the movement of mechanical arm 16 from hinged magnetic tab 17.

FIG. 4 is a detailed drawing of magnetic tab assembly 17. Magnetic tab assembly 17 consists of an upper tab 17*b* and a lower tab 17*a* which are connected by an upper tab hinge 17*d*. Upper tab hinge 17*d* allows upper tab 17*b* to rotate within a 90 degree arc relative to lower tab 17*a* and thus account for various book thicknesses. A magnet 17*c* is mounted in upper tab 17*b*. Magnetic tab assembly 17 is mounted to mechanical arm 16 at a main hinge 17*e*.

FIG. 5 is the electrical schematic of the control unit. A microprocessor U1 is the main controller and sends instructions to a motor driver U2 which chives arm motor 21, associated with diodes D1–4 and tab motor 25, associated with diodes D5–8. Forward page switch 12 and reverse switch 13 notifies microprocessor U1 of user inputs. LEDs D9 and D10 and detectors Q2 and Q3 notify microprocessor U1 of the aim position. A transistor Q1C supplies power to motor driver U2 and motors 21 and 25. A transistor Q1D supplies power to LEDs D9 and D10 and detectors Q2 and Q3. This enables microprocessor U1 to shut off power to extraneous circuits during long periods of inactivity to conserve battery life. A direct current voltage source V1 provides power to all electronic components and can comprise of a battery or alternating current adapter.

OPERATION OF PREFERRED EMBODIMENT

Figure 7:
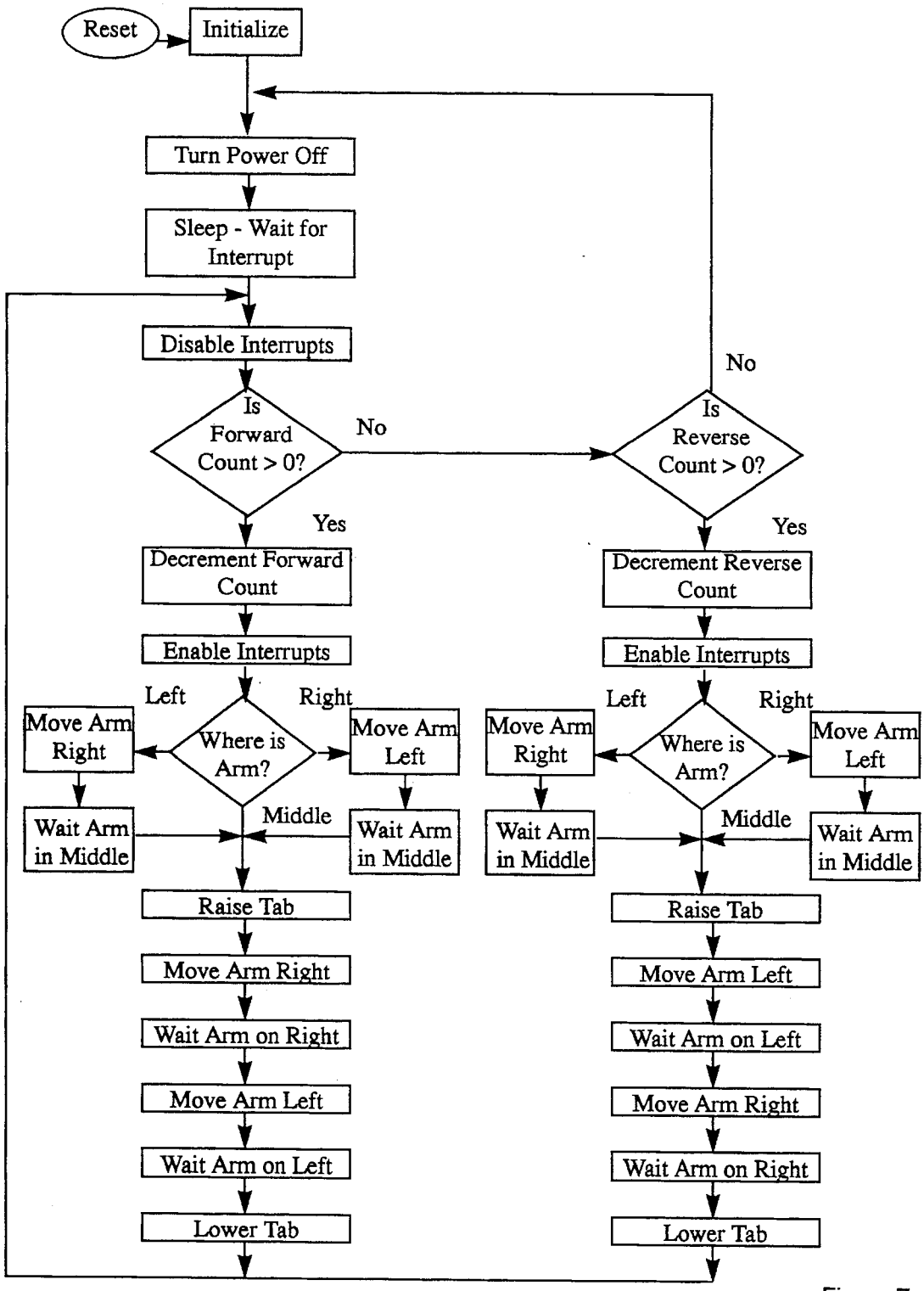
FIG. 7 is the main controller flowchart.

During power up, the device initializes itself. Referring to FIGS. 1, 2, and 7, the initialization sequence begins with microprocessor U1 on printed circuit board 40 moving arm 16 to the left side and magnetic tab assembly 17 to the downward position. Upon detecting that arm 16 and tab assembly 17 are in the proper states, microprocessor U1 turns off motors 21 and 25. This is the forward page turn stand-by position with arm 16 on the left side and tab assembly 17 in the downward position. Microprocessor U1 determines arm 16 to be in the left third of its travel when detector **24*b* is blocked from LED 24*a* by sum position indicator 30. Similarly microprocessor U1 determines arm 16 to be in the right third of its travel when detector 23*b* is blocked from LED 23*a* by arm position indicator 30. When neither detector 23*b* nor 24*b* is blocked by arm position indicator 30, microprocessor U1 determines that arm 16** is in the middle third of its travel.

When the user presses forward page turn foot switch 12, microprocessor U1 activates arm motor 21 causing arm 16 to move in a counterclockwise direction toward the page on the right side. When microprocessor U1 senses that arm 16 has reached the middle third point of its travel, microprocessor U1 activates tab motor 25. This causes tab gear assembly 26 to pull tab cable 33 raising tab assembly 17 to the upright position. When arm 16 reaches the rightmost point of its travel, magnet **17*c* on tab assembly 17 engages ferrous tab 14 enabling arm 16 to grab the page. At this point microprocessor U1 detects that arm 16 has completed traversing to the page on the right and reverses the direction of arm motor 21 causing arm 16 to move back towards the left side carrying the page with it. When arm 16 has reached the far left side of its travel, microprocessor U1 detects that arm 16 has reached the left side and turns off arm motor 21. At this point, microprocessor U1 reverses the direction of tab motor 25. As the tension on tab cable 33 is released by the reverse movement of tab motor 25, tab return spring 34 (see FIG. 3) pulls tab assembly 17 to its downward (stand-by) position, disengaging magnet 17*c* (see FIG. 4**) from the page. The device has now returned to its forward page turn stand-by position. This constitutes a forward page turn.

To turn a page in the reverse direction, the user presses reverse page turn switch 13. If the device were in the forward page turn stand-by mode, i.e. arm 16 is resting on the left side, microprocessor U1 moves arm 16 partially to the right direction by activating arm motor 21 in the forward direction until it senses that arm 16 is in the middle third of its travel. At this point, arm motor 21 is turned off and tab motor 25 is activated moving tab assembly 17 into the upright position. When microprocessor U1 senses that tab assembly 17 has reached its upright position via tab up microswitch 27, microprocessor U1 reverses direction of arm motor 21 bringing arm 16 back to the left side. Since tab assembly 17 is upright, magnet **17*c* now engages ferrous tab 14 attached to the page on the left. Microprocessor U1 senses that arm 16 has reached the left side and reverses arm motor 21 again, moving arm 16** to the right carrying the previous page with it.

When microprocessor U1 senses that arm 16 has completed its travel to right side, it turns off arm motor 21 and reverses direction of tab motor 25. As described previously, this action allows tab return spring 34 to pull tab assembly 17 downward disengaging from the page. The device is now in reverse page turn stand-by mode with arm 16 on the right and tab assembly 17 in the downward position. If another reverse page turn is requested by pressing reverse foot switch 13, the page turn action is similar to that described in the second paragraph, except in the reverse direction.

If the user calls for a forward page turn while in reverse stand-by mode, the device will reverse itself in a manner similar to that described previously except in the opposite direction.

As can be seen from the description of operation above, the device can turn any number of pages in either direction and can reverse directions any number of times. The following paragraphs describe the details of the mechanical and electrical operation of the device. Referring to FIG. 3, arm 16 is rotated back and forth by arm motor 21 and arm gear assembly composed of arm motor reduction gears **22*a*, 22*b*, 22*c*, and 22*d*. Arm motor 21 is a reversible DC motor and moves arm 16 clockwise or counterclockwise. The position of arm 16 is communicated to microprocessor U1 by arm position indicator 30 and two LED detector pairs 23*a,b* and 24*a,b*. When arm 16 is on the rightmost third of its travel, arm position indicator 30 obstructs light from LED 23*a* from reaching detector 23*b* thus indicating to microprocessor U1 that arm 16 has reached the right side. The same applies when arm 16 is on the left side and arm position indicator 30 is between LED 24*a* and detector 24*b*. When both LED detector pairs are unobstructed, microprocessor U1 knows that arm 16 is in the middle third of its travel. Tab assembly 17 is normally in the downward position as indicated by the solid outline. When microprocessor U1 activates tab motor 25 in the forward direction, worm gear 26*a* rotates spur gear 26*b* causing gear rack 26*c* to move to the right. This causes tab cable 33 to pull tab assembly 17 upright as shown by the phantom lines. When tab motor 25 is reversed, tab return spring 34 pulls tab assembly 17 back to the downward position. Tab position is sensed indirectly by placing tab up switch 27 and tab down switch 28 under gear rack 26*c*. Tab cable 33 is routed through the center of hollow arm shaft 29 along pulleys 32*a* and 32*b* so that the position of arm 16 has little or no effect on the position of tab assembly 17. The act of gears 26*a*, 26*b*, 26*c*, and tab motor 25 pulling on tab cable 33 creates a downward force along hollow arm shaft 29 causing possible jamming of arm gear assembly 22*a*, 22*b*, 22*c*, and 22*d*. To isolate and alleviate this stress, thrust bearing 31 is placed between arm 16 and enclosure 15**.

FIG. 4 shows a detailed view of tab assembly 17 in the downward position. Tab assembly consists of lower tab **17*a*, upper tab 17*b*, magnet 17*c*, upper tab hinge 17*d*, and main tab hinge 17*e*. Upper tab 17*b* is designed to swing in a limited arc, 90 degrees, along upper tab hinge 17*d* since books of printed material rarely rest exactly parallel to backboard 10 and the thickness of the book will vary the angle at which magnet 17*c* engages ferrous tabs 14. During actuation, tab assembly 17 will rotate in a vertical arc along main tab hinge 17*e* to the upright position (as shown by the phantom lines) stretching tab return spring 34. When tension on tab cable 33 is released during reverse movement of tab motor 25, tab return spring pulls tab assembly 17** to its downward position.

Conclusions, Ramifications, and Scope of Invention

Thus the reader can conclude that the device described in this document provides the user with a reliable means of turning any number pages of printed material in either direction. The device can handle a wide range of page sizes and is not much larger than a standard music or reading stand. Our page turning device is quiet and efficient in its use of electricity so that battery power is quite practical. The device is designed so that it will allow placement and removal of printed material with minimal effort and does not obstruct the user from performing manual page turning if so desired.

While our above description contains many specificities, these should not be construed as limitations on the scope of the invention, but rather as an exemplification of one preferred embodiment thereof. Many other variations are possible. For example, (1) the entire device may be incorporated into a music or reading stand; (2) the large backboard may be omitted so that there is only a stand-alone turning mechanism placed on an existing stand; (3) different firmware may be used so that the device operates with modified motion control; (4) the motors can be replaced with other electro-mechanical devices such as solenoids; (5) alternate switches can be used such as hand switches, wireless switches, breath operated switches, or motion operated switches; (6) use of any variation of electronic components as a motion controller; (7) use of various gear/belt assemblies that perform the same tasks as those described herein; (8) reversal of parts to provide for use with text read right to left. Accordingly, the scope of the invention should be determined not by the embodiment(s) illustrated, but by the appended claims and their legal equivalents.

We claim:

1. A device for turning pages comprising:

in combination, a first assembly having a first electro-motive device and first means for conveying rotational energy from said first electro-motive device to a final drive shaft, said assembly being mounted on a frame;

an arm member mounted on one end to said final drive shaft, said arm member being rotationally moveable in a horizontal plane;

a magnetic tab mounted pivotally on opposite end of said arm member, said tab being rotationally moveable in a vertical plane;

in combination, a second assembly having a second electro-motive device and second means of converting rotational energy to linear energy from said second electro-motive device to said magnetic tab causing said magnetic tab to pivot;

an electronic circuit that controls the operation of said electro-motive devices; and an electro-mechanical transducer connected to said electronic circuit adapted to communicate an user inputs to said electronic circuit.

2. The device for turning pages of claim 1, further including a stand means of supporting a book, said device for turning pages being mounted to said stand.

3. The device for turning pages of claim 1, further including a means of indicating position of said arm member to said electronic circuit.

4. The device for turning pages of claim 1, further including a means of indicating position of said magnetic tab member to said electronic circuit.

5. The device for turning pages of claim 1 wherein said magnetic tab is hinged so as to allow rotational movement of said magnetic tab in a horizontal plane.

6. The device for turning pages of claim 5, further including a stand means of supporting a book, said device for turning pages being mounted to said stand.

7. The device for turning pages of claim 5, further including a means of indicating position of said arm member to said electronic circuit.

8. The device for turning pages of claim 5, further including a means of indicating position of said magnetic tab member to said electronic circuit.

9. A device for turning pages comprising:

a first assembly having a first electro-motive device and first means for conveying rotational energy from said first electro-motive device to a final drive shaft, said assembly being mounted on a frame;

an arm member mounted on one end to said final drive shaft, said arm member being rotationally moveable in a horizontal plane;

a magnetic tab mounted pivotally on said arm member, distal to said shaft, said tab being rotationally moveable from a down position to an upright position in a vertical plane;

a second assembly having a second electro-motive device and second means of converting rotational energy to linear energy from said second electro-motive device to said magnetic tab causing said magnetic tab to pivot;

an electronic circuit that controls the operation of said electro-motive devices; and an electro-mechanical transducer connected to said electronic circuit adapted to communicates user inputs to said electronic circuit.

10. The device for turning pages of claim 9, further including a stand means of supporting a book, said device for turning pages being mounted to said stand.

11. The device for turning pages of claim 9, further including a means of indicating position of said arm member to said electronic circuit.

12. The device for turning pages of claim 9, further including a means of indicating position of said magnetic tab member to said electronic circuit.

13. A device for turning pages comprising:

a frame;

a first electric motor mounted to said frame and operably engaged to a rotatable shaft;

an arm mounted on said shaft between a first arm position and a second arm position at a proximal end for rotation through an arc by said shaft;

a member pivotally mounted at a distal end of said arm and biased to reside in a first position generally parallel to said arm;

a magnetic tab on said member;

a second electric motor mounted to said frame;

means to convert rotary motion to linear motion operably associated with said second motor;

a transmission means linking said member to said means to convert rotary power in order to pivot said member to a second position, which is not parallel to said arm when said second motor is actuated;

a controller for operating said motors;

a forward switch operably connected to said controller for sequentially moving said arm and said tab for moving the page from a first position to a second position a reverse switch operably connected to said controller for sequentially moving said arm and said tab for moving the page from said second position to said first position and a power source for said electronics.

14. The device for turning pages of claim 13, further including a back positioned adjacent to said frame and extending generally parallel to the arc of said arm.

15. The device for turning pages of claim 13 wherein said arc is determined by an arm position indicator attached to said shaft and aligned to pass detection means operably attached to said controller, said detection means being position at each end of said arc to stop said first motor when said arm arrives at a predetermined location.

16. The device for turning pages of claim 13 wherein said tab is biased by a spring.

17. The device for turning pages of claim 13 wherein said controller is a microprocessor.

18. The device for turning pages of claim 13 wherein said means to convert rotary power to linear power comprises a pinion gearably engaged to said second motor.

19. The device for turning pages of claim 13 wherein said transmission means is a cable.

20. The device for turning pages of claim 19 wherein said shaft is hollow and said cable passes through said hollow shaft and along said arm.

* * * * *